US012410617B2

(12) United States Patent
Melcher

(10) Patent No.: US 12,410,617 B2
(45) Date of Patent: Sep. 9, 2025

(54) BACKING CONNECTOR

(71) Applicant: Simpson Strong-Tie Company Inc., Pleasanton, CA (US)

(72) Inventor: Travis Clifton Melcher, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 43 days.

(21) Appl. No.: 18/072,522

(22) Filed: Nov. 30, 2022

(65) Prior Publication Data

US 2023/0167639 A1 Jun. 1, 2023

Related U.S. Application Data

(60) Provisional application No. 63/284,598, filed on Nov. 30, 2021.

(51) Int. Cl.

| | |
|---|---|
| ***E04B 1/38*** | (2006.01) |
| ***E04C 3/02*** | (2006.01) |
| ***E04C 3/08*** | (2006.01) |
| *E04B 1/24* | (2006.01) |
| *E04B 1/26* | (2006.01) |
| *E04C 3/04* | (2006.01) |

(52) U.S. Cl.

CPC ..... *E04C 3/08* (2013.01); *E04B 2001/2415* (2013.01); *E04B 1/2608* (2013.01); *E04C 2003/026* (2013.01); *E04C 2003/0473* (2013.01)

(58) Field of Classification Search

CPC ..... E04C 2003/0473; E04C 2003/026; E04C 3/292; E04B 1/2403; E04B 1/2604; E04B 1/2608; E04B 1/2612; E04B 2001/2415; E04B 2001/2424; E04B 2001/2457; E04B 2001/246; E04B 2001/2644; E04B 2001/2648; E04B 2001/2696

See application file for complete search history.

(56) References Cited

U.S. PATENT DOCUMENTS

| | | | |
|---|---|---|---|
| 254,965 | A | 3/1882 | Hart |
| 261,919 | A | 8/1882 | Gibbons |
| 292,003 | A | 1/1884 | Garretson |
| 451,596 | A | 5/1891 | Longenecker |
| 891,604 | A | 6/1908 | Diamond |
| 1,471,159 | A | 10/1923 | Howie et al. |

(Continued)

FOREIGN PATENT DOCUMENTS

| | | |
|---|---|---|
| FR | 1295797 | 7/1961 |
| GB | 168471 | 9/1921 |
| GB | 742617 | 12/1955 |

OTHER PUBLICATIONS

DSP/SSP/SP/SPH/RSP4/TSP/CS—Stud Plate Ties, catalog, 2019-2020, p. 274 and front and back covers, Wood Construction Connectors C-C-2019, Simpson Strong-Tie Company, Pleasanton, USA.

(Continued)

*Primary Examiner* — Kyle J. Walraed-Sullivan
(74) *Attorney, Agent, or Firm* — Charles R. Cypher

(57) ABSTRACT

A connection between a stud and one or more separate backing members is made with separate fasteners and a backing connector. The backing connector has a planar web with first and lateral side plates extending therefrom, with the backing members attached to the first and second side plates and the web of the backing connector attached to the stud.

18 Claims, 8 Drawing Sheets

(56) References Cited

U.S. PATENT DOCUMENTS

| | | | | |
|---|---|---|---|---|
| 2,037,736 | A | 4/1936 | Payne et al. | |
| 2,203,987 | A | 6/1940 | Galante | |
| 2,268,681 | A | 1/1942 | Vernon | |
| 2,302,194 | A | 11/1942 | Dayton | |
| 2,365,501 | A | 12/1944 | Walstrom | |
| 2,874,708 | A | 2/1959 | Daus, Jr. | |
| 3,210,898 | A | 10/1965 | Kurtz | |
| 3,669,480 | A | 6/1972 | Fugate | |
| 3,912,407 | A | 10/1975 | Heininger | |
| 4,024,691 | A | 5/1977 | Hansen et al. | |
| 4,076,431 | A | 2/1978 | Burvall | |
| 4,275,534 | A | 6/1981 | Porter | |
| 4,526,348 | A | 7/1985 | Cammack | |
| 4,572,695 | A | 2/1986 | Gilb | |
| 4,703,593 | A | 11/1987 | Smolik | |
| 4,804,094 | A | 2/1989 | Eittreim | |
| 4,812,075 | A | 3/1989 | Lavin, Sr. | |
| 4,885,883 | A | 12/1989 | Wright | |
| 4,910,939 | A | 3/1990 | Cavanagh | |
| 5,150,982 | A | 9/1992 | Gilb | |
| 5,170,977 | A | 12/1992 | McMillan | |
| 5,249,400 | A | 10/1993 | Turner | |
| 5,259,685 | A | 11/1993 | Gilb | |
| 5,328,287 | A | 7/1994 | Gilb | |
| 5,372,448 | A | 12/1994 | Gilb | |
| 5,399,044 | A | 3/1995 | Gilb | |
| 5,403,110 | A * | 4/1995 | Sammann | E04B 1/5831 52/712 |
| 5,439,201 | A | 8/1995 | Landreville | |
| D364,331 | S | 11/1995 | Lee | |
| 5,488,810 | A | 2/1996 | Horton | |
| 5,697,725 | A * | 12/1997 | Ballash | E04B 1/2608 403/231 |
| 5,836,131 | A * | 11/1998 | Viola | E04B 1/2612 52/715 |
| 5,961,242 | A | 10/1999 | Leone | |
| 6,022,165 | A | 2/2000 | Lin | |
| 6,230,467 | B1 * | 5/2001 | Leek | F16B 9/052 52/715 |
| 6,705,056 | B2 | 3/2004 | Tollenaar | |
| 7,331,149 | B2 | 2/2008 | Tollenaar | |
| 7,356,973 | B2 | 4/2008 | Roesset et al. | |
| 7,398,621 | B2 | 7/2008 | Banta | |
| 7,520,100 | B1 | 4/2009 | Herrman et al. | |
| 7,559,519 | B1 | 7/2009 | Dragic et al. | |
| 7,634,889 | B1 * | 12/2009 | diGirolamo | F16B 9/052 52/712 |
| 8,590,255 | B2 | 11/2013 | Daudet et al. | |
| 8,689,508 | B2 | 4/2014 | Orszulak et al. | |
| 8,813,456 | B2 | 8/2014 | Lin et al. | |
| 9,376,797 | B2 | 6/2016 | Yang | |
| 10,422,140 | B2 | 9/2019 | Mitchell | |
| 10,450,737 | B2 | 10/2019 | Bowron | |
| 10,858,819 | B2 | 12/2020 | Styrc | |
| 11,105,085 | B2 | 8/2021 | Hensen et al. | |
| 12,012,746 | B2 | 6/2024 | Beach | |
| 2005/0072099 | A1 * | 4/2005 | Roesset | E04C 3/12 52/633 |
| 2006/0137284 | A1 | 6/2006 | Window | |
| 2006/0213136 | A1 * | 9/2006 | Lin | E04B 1/2604 52/295 |
| 2007/0209312 | A1 * | 9/2007 | Keys | F16B 9/052 52/696 |
| 2008/0053034 | A1 * | 3/2008 | Matechuk | E04B 1/24 52/702 |
| 2009/0113839 | A1 * | 5/2009 | Carr | E04B 1/2612 52/712 |
| 2015/0143770 | A1 * | 5/2015 | Lin | E04B 2/7457 52/655.1 |
| 2016/0108640 | A1 | 4/2016 | Graber | |
| 2018/0135296 | A1 * | 5/2018 | Brekke | B21D 47/00 |
| 2018/0355602 | A1 * | 12/2018 | Evans | E04B 1/2612 |
| 2019/0136520 | A1 | 5/2019 | Daudet | |
| 2023/0048980 | A1 | 2/2023 | Tiner | |

OTHER PUBLICATIONS

KB—Wall Support Backing Kwik-Back, website catalog, accessed Aug. 30, 2018, SCAFCO Steel Stud Company, Spokane, USA.

RTA/RTB/RTF/RTT/RTU/FW2—Rigid Tie Connectors, catalog, 1994, p. 67, Simpson Strong-Tie Company, Pleasanton, USA.

LPC—Post Caps, catalog, 1993, p. 23, BuyLine 5162, Simpson Strong-Tie Company, Pleasanton, USA.

* cited by examiner

BACKING CONNECTOR

BACKGROUND OF THE INVENTION

Field of the Invention

The present invention relates to wall construction, and more particularly to a method and apparatus for providing a connection between two or more wall studs to provide reinforcement to the studs and to provide backing members between the studs for anchoring wall mounted structures such as cabinets, handrails, and grab bars to the backing member.

Description of Prior Art

Walls in light-framed buildings are often formed with wood studs and top and bottom sills. In recent years, however, the use of metal studs has gained acceptance, especially in commercial buildings, but also in residential construction. Some designers prefer to use metal studs and tracks rather than wood studs and sills.

Wood studs typically have nominal cross-sectional dimensions of two inches by four inches. Metal studs are typically formed of sheet metal bent to encompass a cross sectional area having nominal dimensions of two inches by four inches. Metal studs are typically formed of sheet metal bent into a generally C-shaped cross-section in which a relatively broad central web is flanked by a pair of narrower side members that are bent at right angles from the web. The web typically has a width of three and ⅝ inches. The side members of the C-shaped stud typically extend a nominal two inches from the web. To enhance the structural rigidity of the side members of the stud, the ends of the side members are normally bent over into a plane parallel to and spaced from the plane of the web. These turned over edges of the side members form marginal lips which are typically one quarter to one half inch in width. The metal studs are often erected with the webs oriented on the same side in the same direction.

In building construction, there are certain situations which require the building studs to be braced or linked transversely to provide enhanced structural rigidity. Often studs are transversely bridged when they are over eight feet in length so that they provide adequate stability in a lateral direction within the wall which they support.

In certain instances, studs require transverse backing between the studs in a building to provide structural support against forces acting normal to or parallel to the plane of the wall. For example, structural backing is provided between adjacent parallel studs for the installation of wall structures such as cabinets, handrails, and grab bars. In the United States, handrails and grab bars may have to conform to requirements of the Americans with Disabilities Act. A common way to provide backing is to place pieces of plywood or other members between adjacent studs and use screw fasteners to attach these pieces to adjacent studs. The number and placement of backing pieces is determined by the expected forces acting on the studs and the backing members. Typically, drywall (also known as plasterboard, wallboard, gypsum board, sheetrock, or gyprock) panels cover the studs and backing.

The use of firestops, bridging and backing in construction trade is well known in the prior art. There are many patents that teach backing pieces, bridging members, and blocking members that are formed from sheet metal for use with studs.

SUMMARY OF THE INVENTION

The present invention provides a connection between a stud and backing pieces that is easily erected and allows for the secure attachment of components to a hollow wall that may be sheathed with drywall panels. In one embodiment of the invention, one or more sheet metal connectors are attached to the vertical studs and blocking pieces are attached to the one or more connectors.

In one embodiment of the invention where the connector is attached to a sheet metal stud, the wall stud of the connection has an elongated, vertically disposed, substantially planar web. The web has a given width and has an exterior surface on one side of the web and an interior surface on the opposite side of the web. The first wall stud is also formed with a substantially planar side member laterally connected to the web, the side member being disposed orthogonally to the web and running alongside the web, the side member extending from the interior surface side of the web and having an outer surface on one side of the side member and an interior surface on the opposite side of the side member. The first wall stud also has a substantially planar lip flange laterally connected to the side member opposite from the web, the lip flange being disposed parallel to the web and orthogonally to the side member, the lip flange running alongside the side member and being disposed on the interior surface side of the web. The lip flange has a selected width that is substantially narrower than the web. The lip flange has an interior surface that faces the interior surface of the web on one side of the lip flange and a facing surface on the opposite side of the lip flange.

The connector of the connection is disposed in interfacing engagement with the wall stud. The connector has an elongated, substantially planar web having a longitudinal axis with a first end and a second end. The longitudinal axis is disposed substantially aligned with the long axis of the elongated wall stud. The web has an exterior surface on one side of the web and an interior surface on the opposite side of the web. The interior surface of the web interfaces with a portion of the side member of the wall stud.

The connector is also formed with a substantially planar first lateral plate laterally connected to a first lateral side of the web. The connector is also formed with a substantially planar second lateral plate laterally connected to a second lateral side of the web.

To make the connection to the wall stud, fasteners are driven through the web of the connector into the side member of the wall stud.

To make the connection to the blocking pieces, separate fasteners are driven through the first and second lateral plates and into blocking pieces interfacing with the first and second lateral plates. The preferred fasteners are self-drilling, self-tapping screws with low profile heads.

DETAILED DESCRIPTION OF THE INVENTION

Figure 1:
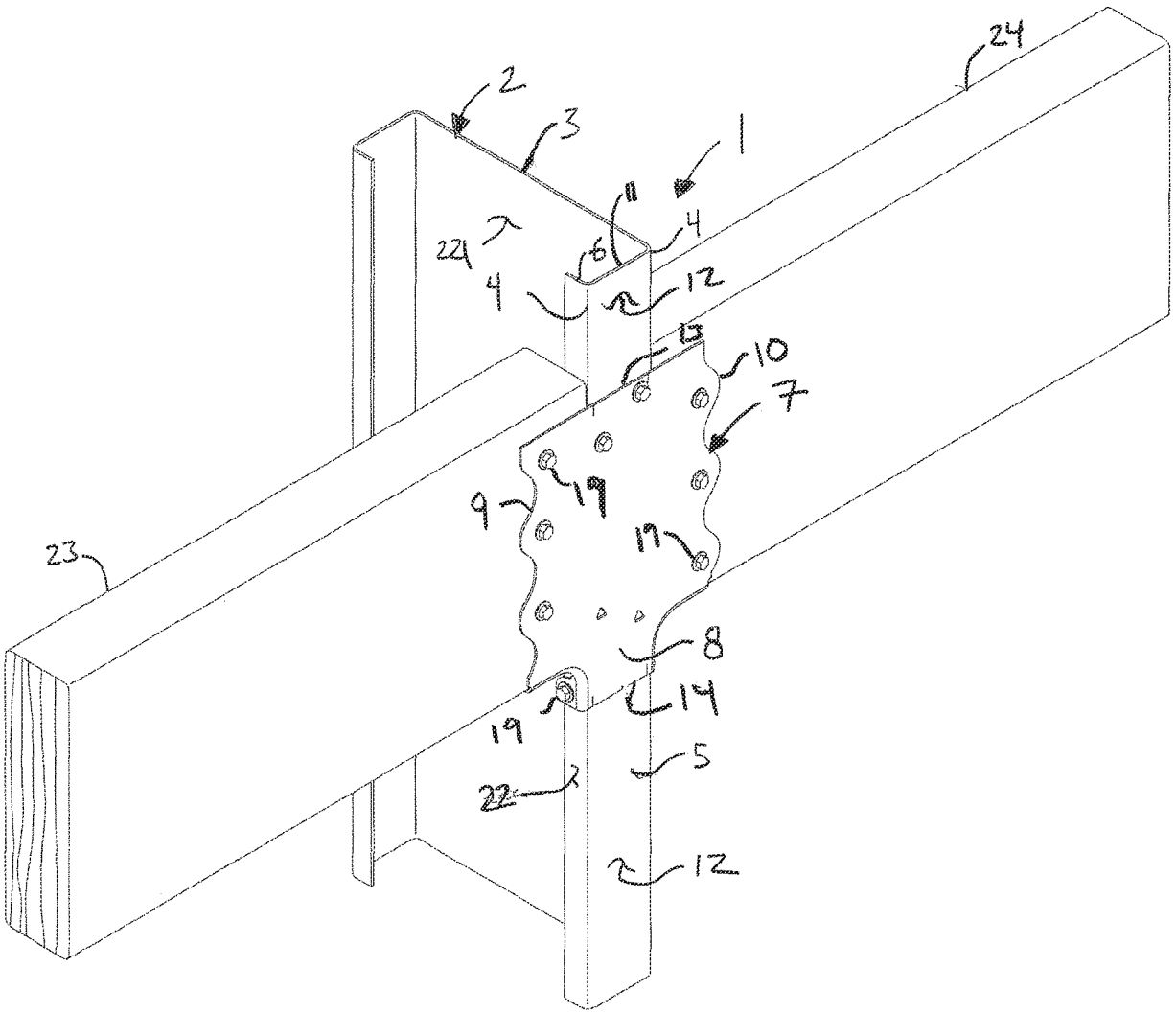
FIG. 1 is an upper front perspective view of a connection made according to the present invention between a wall stud and the connector and blocking pieces of the present invention.

As shown in FIG. 1, in the preferred embodiment, the connection 1 of the present invention includes a wall stud 2 having a first stud web or front surface 3 with a first vertical edge 4, a first side flange or side member 5 extending from the first vertical edge 4, the first side flange 5 having a second vertical edge 4, and a lip flange or lip surface 6 extending from the second vertical edge 4. The elongated, vertically disposed, substantially planar web 3 has a given width and has an exterior surface 21 on one side of the web 3 and an interior surface 221 on the opposite side of the web 3. The substantially planar side member 5 laterally connected to the web 3 is disposed orthogonally to the web 3 and extends therefrom. The side member 5 extends from the interior surface side 221 of the web and has an outer surface 12 on one side of the side member 5 and an interior surface 11 on the opposite side of the side member 5. The substantially planar lip flange 6 is laterally connected to the side member 5 opposite from the web 3. The lip flange 6 is disposed parallel to the web 3 and orthogonally to the side member 5. The lip flange 6 extends from the side member 5 and is disposed on the interior surface side 221 of the web 3. The lip flange 6 has a selected width that is substantially narrower than the web 3, the lip flange 6 has an interior surface 222 that faces the interior surface 221 of the web 3 on one side of the lip flange 6 and a facing surface 22 on the opposite side of the lip flange 6. As shown in FIG. 1, in the preferred embodiment, the backing connector 7 is formed with a web 8. A first lateral side plate 9 extends from the web 8 to one side of the web 8 and a second lateral side plate 10 extends from an opposite side of the web 8.

Figure 3:
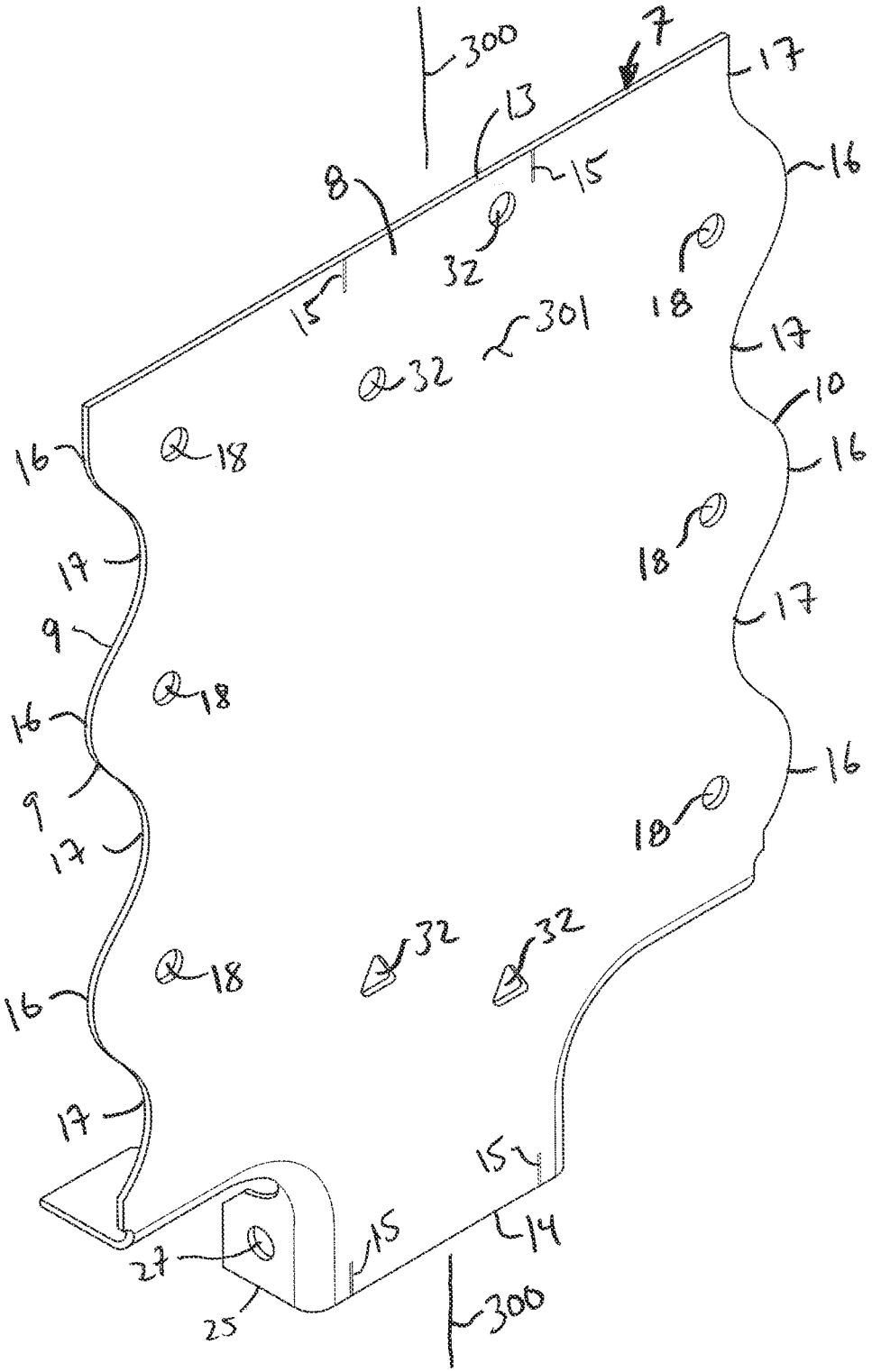
FIG. 3 is an upper front perspective view of the connector shown in FIG. 1.
Figure 4:
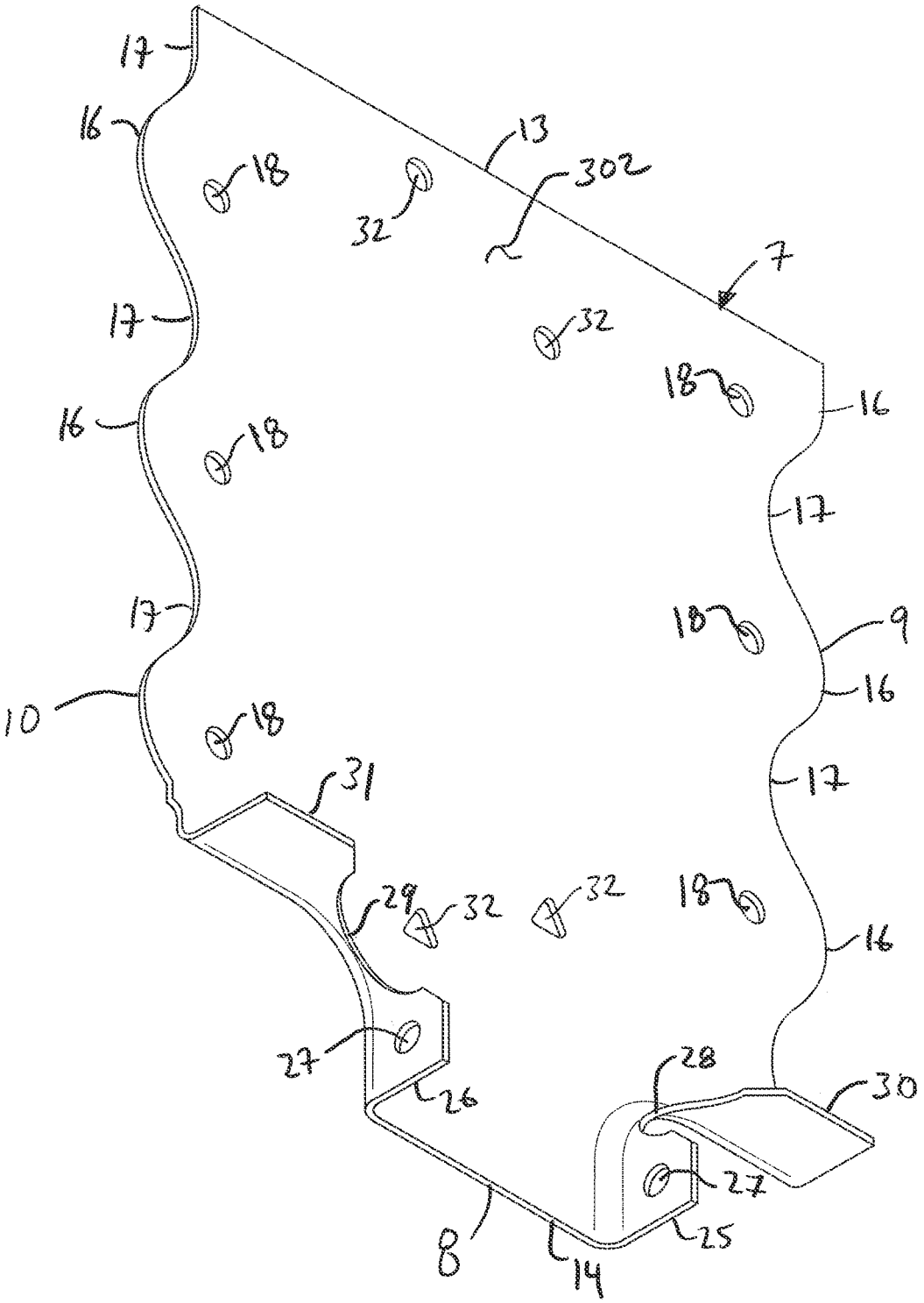
FIG. 4 is a lower rear perspective view of the connector shown in FIG. 4.
Figure 5:
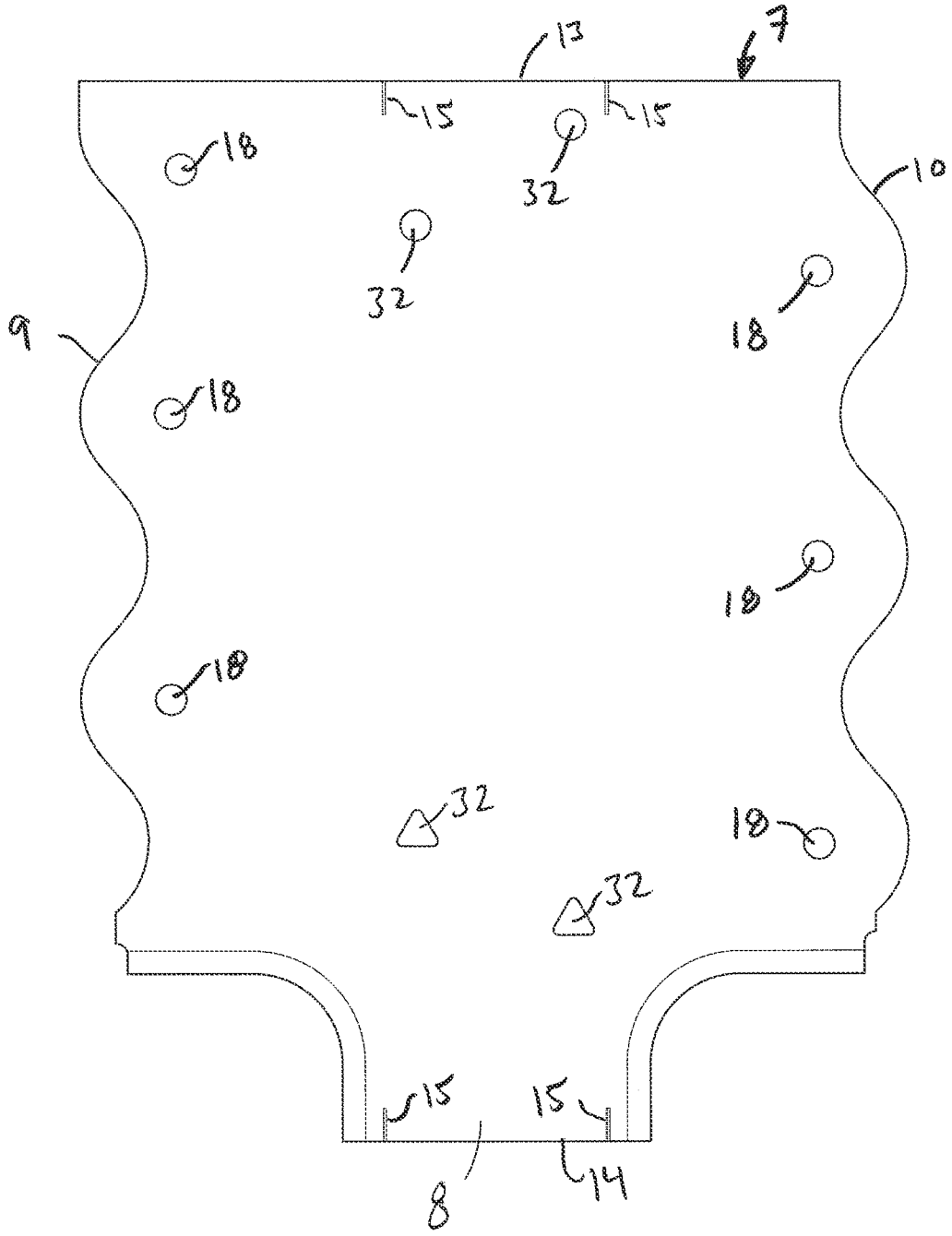
FIG. 5 is a front elevation view of the connector shown in FIG. 4.
Figure 6:
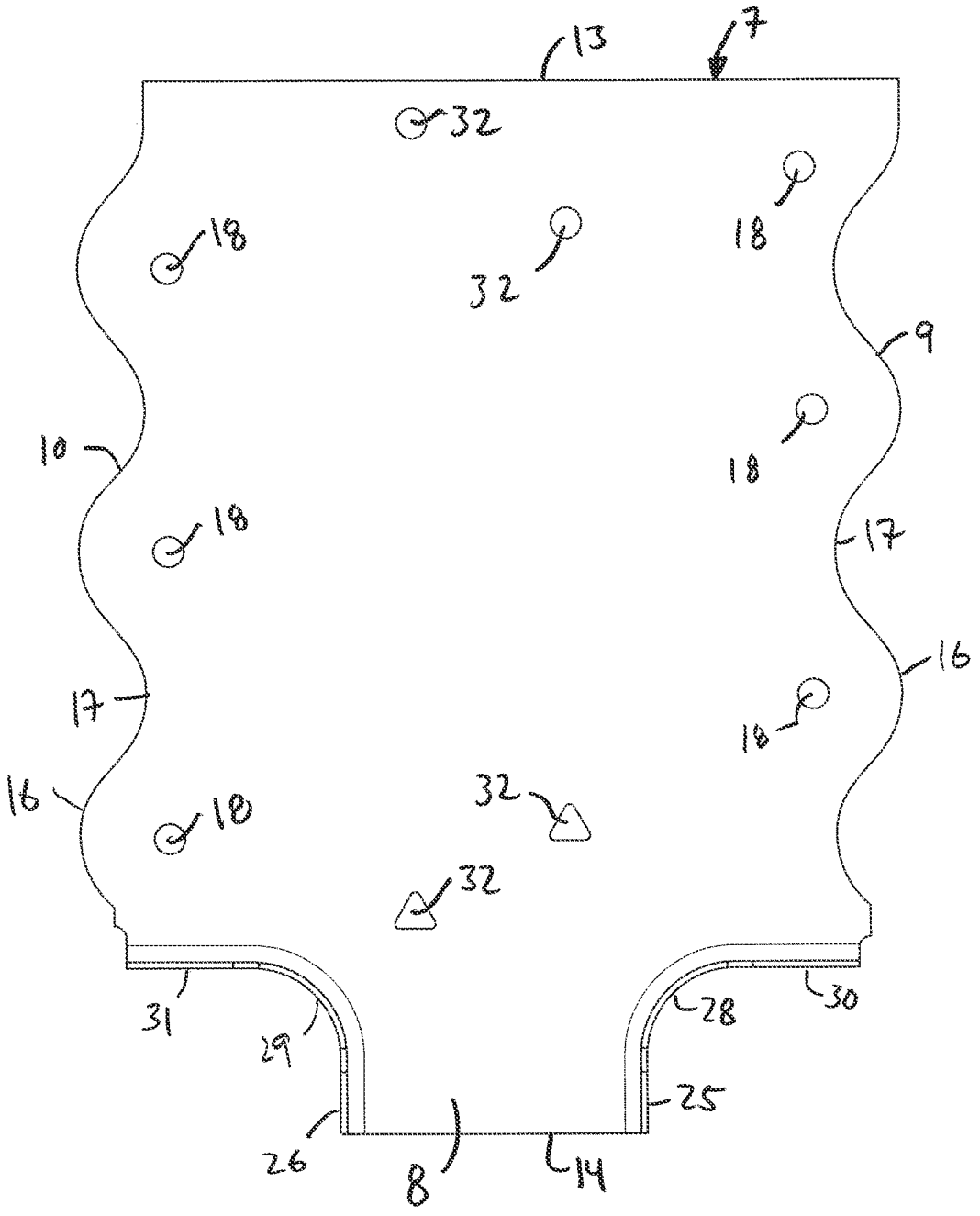
FIG. 6 is a back elevation view of the connector shown in FIG. 4.
Figure 7:
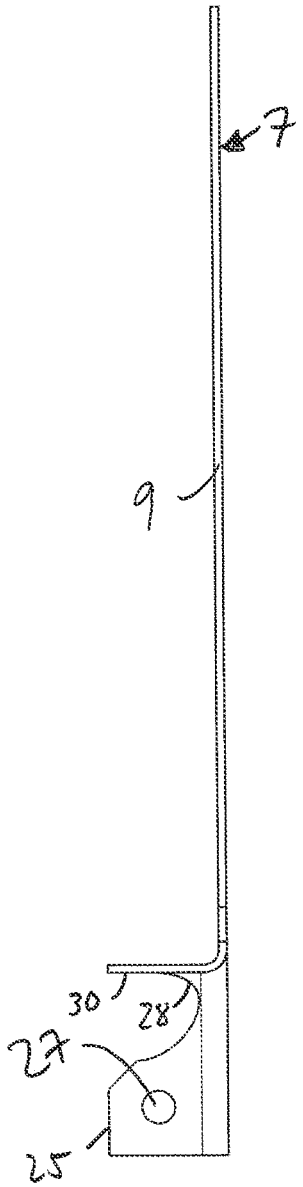
FIG. 7 is a left side view of the connector shown in FIG. 4.
Figure 8:
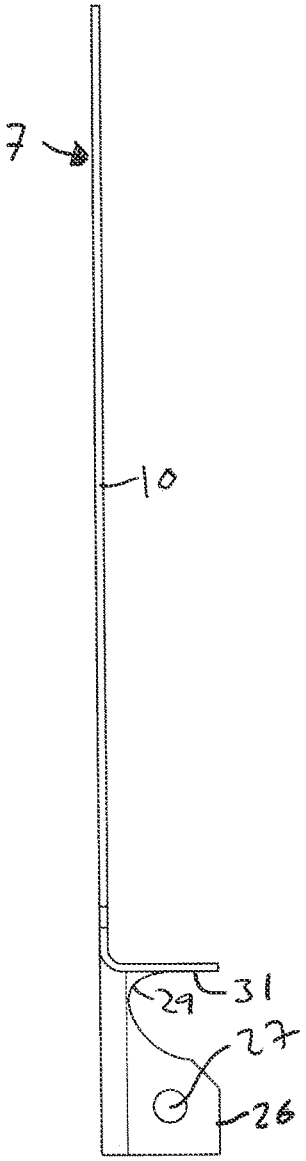
FIG. 8 is a right side view of the connector shown in FIG. 4.
Figure 9:
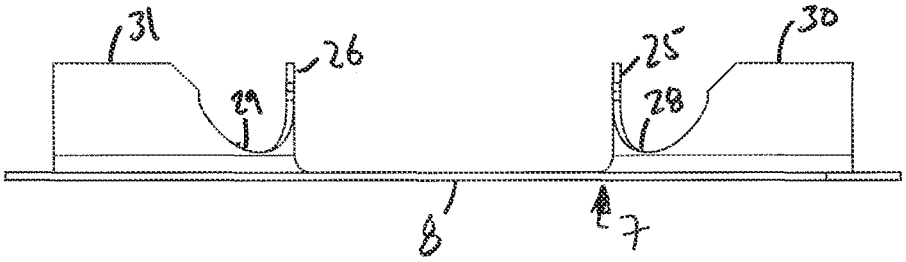
FIG. 9 is a top plan view of the connector shown in FIG. 4.
Figure 10:
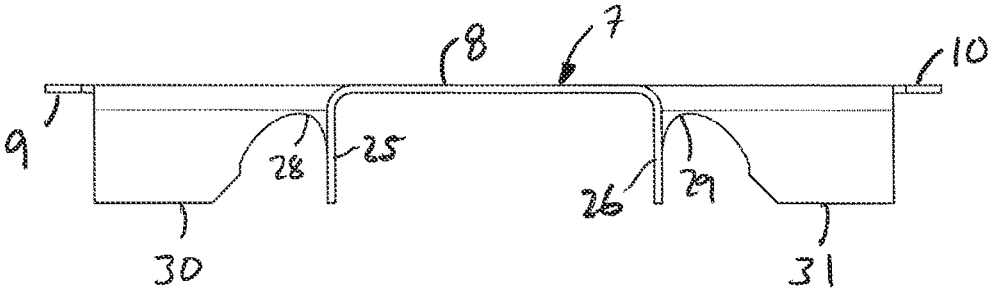
FIG. 10 is a bottom plan view of the connector shown in FIG. 4.

The backing connector 7 interfaces with the side member 5 of the stud 2. As shown in FIG. 3, the connector 7 has a longitudinal axis 300 and the web 8 has an upper end 13 and a lower end 14. As shown in FIG. 1, when the connection 1 is made, preferably the longitudinal axis 300 is disposed substantially aligned with the elongated wall stud 2. As shown in FIGS. 3 and 4, the web 8 has an exterior surface 301 on one side of the web 8 and an interior surface 302 on the opposite side of the web 8. The interior surface 301 of the web 8 is substantially in alignment and interfacing with the outer surface 12 of the side member 5 of the wall stud 2.

As shown in FIG. 3, at the upper and lower ends 13 and 14 of the web 8, the side portions of the web 8 are provide with grooves or indicia 15 that extend parallel with the longitudinal axis 300 of the connector 7. These grooves 15 help the installer align the connector 7 with the stud 2, as the grooves are also formed close to where the vertical edges of the side member 5 of the stud 2 are disposed for a typical stud used in light frame construction.

As shown in FIG. 3, the outer lateral edges of the first and second lateral side plates 9 and 10 are formed as undulating, curved members with protruding portions 16 and indented portions 17. Preferably the fastener openings 18 in the first and second lateral side plates 9 and 10 for receiving the fasteners 19 that connect the connector 7 to the first and second blocking or backing members 23 and 24 are formed laterally close to the protruding portions 16 so that they may be positioned farther away from the central portion of the connector 7 while being surrounded by sufficient material of the connector 7 to securely anchor the fasteners received by the openings 18. By forming the edges as undulated, curved members the connectors can be made on an automated die from coil of sheet material while saving material.

As shown in FIGS. 3 and 4, near the lower end 14 of the web 8, the web 8 is provided with first and second attachment tabs 25 and 26 that extend orthogonally from the web 8. Each attachment tab 25 and 26 is formed with a fastener opening 27. As shown in FIG. 1, attachment tab 25 interfaces with the exterior surface 22 of the lip flange 6. Similarly, attachment tab 26 interfaces with the exterior surface 21 of the web 3 of the stud 2. Fasteners 19 connect the first attachment tab 25 to the lip flange 6 and the second attachment tab 26 to the web 3 of the stud 2.

Figure 2:
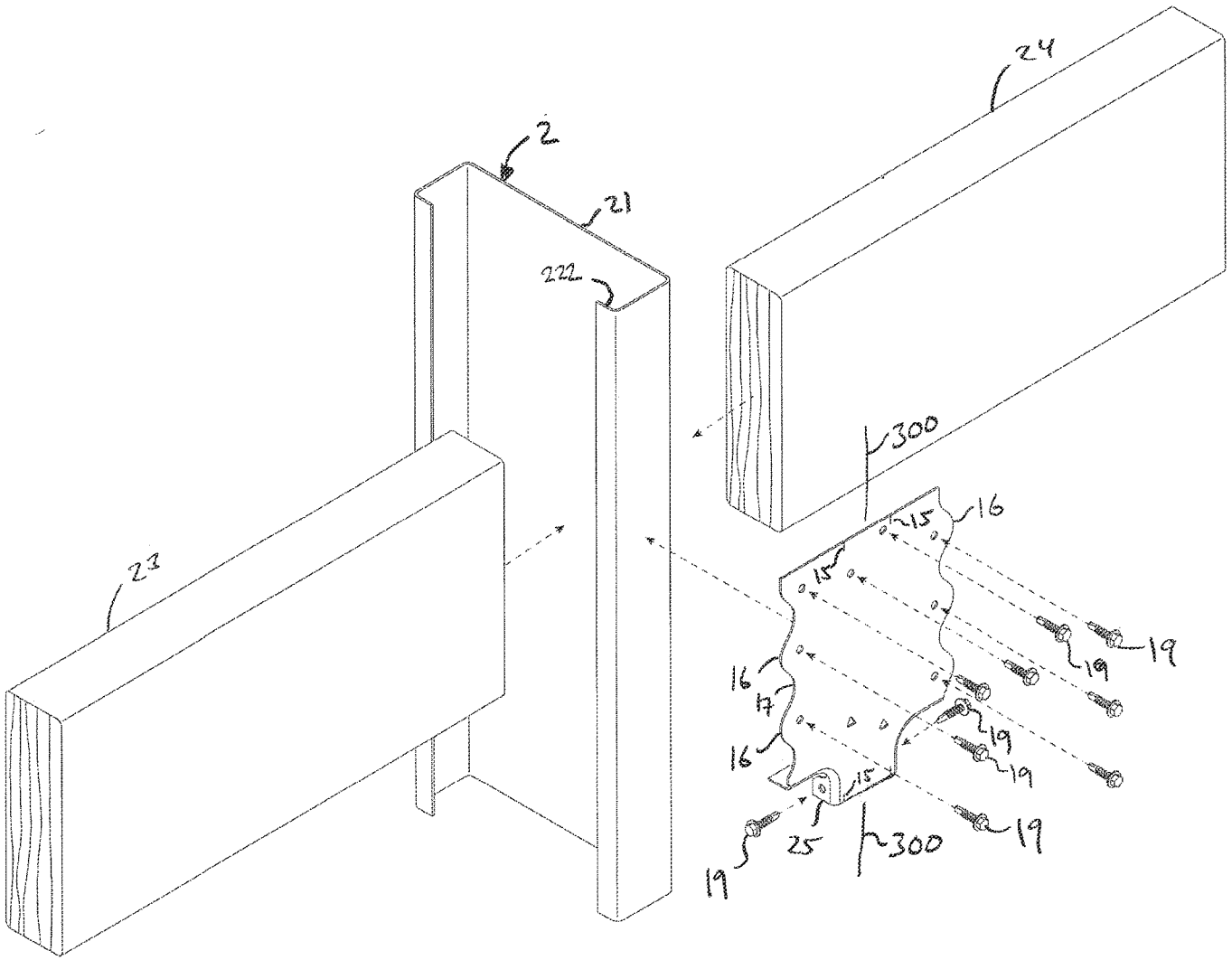
FIG. 2 is an exploded view of the connection of FIG. 1.

As shown best in FIGS. 3 and 4, the first and second attachment tabs 25 and 26 are each connected to respective first and second curved strengthening flanges 28 and 29 that turn and flare outwardly 90 degrees from the orientation of the first and second attachment tabs 25 and 26 which are substantially planar. The curved strengthening flanges 28 and 29 are connected to respective first and second strengthening tabs 30 and 31. The first and second strengthening tabs 30 and 31 are substantially planar and are disposed orthogonally to the first and second attachment tabs 25 and 26, and they are also disposed orthogonally to the first and second lateral side plates 9 and 10. As best shown in FIGS. 1 and 2, in a typical installation, the first and second attachment tabs 25 and 26 extend vertically, and the first and second strengthening tabs 30 and 31 extend horizontally. As shown in FIG. 4, the first and second attachment tabs 25 and 26 and the first and second strengthening tabs 30 and 31 extend further from the web 8 and the first and second lateral side plates 9 and 10 than the first and second curved strengthening flanges 28 and 29, but the curved first and second strengthening flanges do extend from the plane defined by the generally planar web 8 and the generally planar first and second lateral side plates 9 and 10 that extend from the web 8 and are in general alignment with the web 8. The connection between the attachment tabs 25 and 26, the curved strengthening flanges 28 and 29 and the strengthening tabs 30 and 31 provides rigidity to the connector.

To make the connection to the wall stud 2, fasteners 19 are driven through the web 8 into the wall stud 2. Preferably fastener openings 32 are provided in the web 8 to show the preferred placement of the fasteners 19. As shown in FIG. 3, the fastener openings 32 can be different shapes to suggest to the installer that certain fastener openings 32 may be used for additional fasteners 19, if additional strength is needed.

To make the connection to the blocking pieces 23 and 24, separate fasteners 19 are driven through the first and second lateral side plates 9 and 10 and into blocking pieces 23 and 24 interfacing with the first and second lateral side plates 9 and 10. The preferred fasteners are self-drilling, self-tapping screws with low profile heads. Preferably fastener openings 18 are provided in the first and second lateral side plates 9 and 10 to show the preferred placement of the fasteners. The connector is preferably made from sheet metal on an automated die.

The blocking pieces 23 and 24 are preferably formed with bottom edges and the first and second strengthening tabs 30 and 31 interface with a respective bottom edges of the blocking pieces.

I claim:

1. A connection between a wall stud and one or more backing members, the connection comprising:

a. a wall stud, the wall stud including, a front surface, a side surface set orthogonally to the front surface, and a lip surface disposed opposite the front surface and orthogonally to the side surface, with the wall stud including;

i. a web member, the web member being elongated, vertically disposed, and substantially planar, the web member having a given width and having an exterior surface on one side of the web member that corresponds to the front surface and an interior surface on the opposite side of the web member;

ii. a substantially planar side member laterally connected to the web member, the side member being disposed orthogonally to the web member and running alongside the web member, the side member extending from the interior surface of the web member and having an outer surface on one side of the side member that corresponds to the side surface and an interior surface on the opposite side of the side member; and iii. a substantially planar lip flange laterally connected to the side member opposite from the web member, the lip flange being disposed parallel to the web member and orthogonally to the side member, the lip flange running alongside the side member and being disposed on the interior surface of the web member, the lip flange having a selected width that is substantially narrower than the web member, the lip flange having an interior surface that faces the interior surface of the web member on one side of the lip flange and a facing surface on the opposite side of the lip flange that corresponds to the lip surface;

b. a backing connector, the backing connector being disposed substantially in alignment with the wall stud and connecting the wall stud to one or more backing members, the backing connector including, i. a web, the web being elongated and substantially planar, the web having a longitudinal axis with an upper end and a lower end, the web having an exterior surface on one side of the web and an interior surface on the opposite side of the web, the interior surface of the web being substantially in alignment with and interfacing with the side surface of the wall stud, and ii. first and second, substantially planar lateral side plates extending laterally from the web of the backing connector, at least one of the first and second lateral side plate members interfacing with at least one of the one or more backing members;

c. one or more fasteners connecting the backing connector to the wall stud where the backing connector interfaces with the wall stud the one or more fasteners being driven through the web of the backing connector and into the side surface of the wall stud; and d. one or more fasteners connecting at least one of the first and second lateral side plates to at least one of the one or more backing members;

e. at the lower end of the web of the backing connector, the web is provided with first and second attachment tabs that extend orthogonally from the web with the first attachment tab interfacing with the lip surface of the wall stud and the second attachment tab interfacing with the front surface of the wall stud; and f. one or more fasteners connect the first attachment tab to the lip surface of the wall stud and one or more fasteners connect the second attachment tab to the front surface of the wall stud.

2. The connection of claim 1, wherein:

the web of the backing connector is formed with one or more grooves that extend parallel with the longitudinal axis of the backing connector.

3. The connection of claim 1, wherein:

the web of the backing connector is formed with side portions, and the side portions are provided with one or more grooves that extend parallel with the longitudinal axis of the backing connector.

4. The connection of claim 1, wherein:

a. the first and second lateral side plates are formed with undulating, curved side edges with protruding portions and indented portions; and b. fastener openings are formed in the first and second lateral side plates in or adjacent to the protruding portions.

5. The connection of claim 1, wherein: the first curved strengthening flange connects to a first strengthening tab that is orthogonal to a first attachment tab and is also orthogonal to the first lateral side plate and a second curved strengthening flange connects to a second strengthening tab that is orthogonal to the second attachment tab and is also orthogonal to the second lateral side plate.

6. The connection of claim 5, wherein:

the one or more backing members are formed with bottom edges and the first and second strengthening tabs each interface with a bottom edge of one of the one or more backing members.

7. The connection of claim 1, wherein:

the fasteners are self-drilling and self-tapping screws with heads.

8. The connection of claim 1, wherein:

the web of the backing connector is formed with one or more indicia members that extend parallel with the longitudinal axis of the backing connector.

9. The connection of claim 1, wherein:

the web of the backing connector is formed with side portions, and the side portions are provided with one or more indicia members that extend parallel with the longitudinal axis of the backing connector.

10. A connection between a wall stud and one or more backing members, the connection comprising:

a. a wall stud, the wall stud including, a front surface, a side surface set orthogonally to the front surface, and a lip surface disposed opposite the front surface and orthogonally to the side surface, with the wall stud including;

i. a web member, the web member being elongated, vertically disposed, and substantially planar, the web member having a given width and having an exterior surface on one side of the web member that corresponds to the front surface and an interior surface on the opposite side of the web member;

ii. a substantially planar side member laterally connected to the web member, the side member being disposed orthogonally to the web member and running alongside the web member, the side member extending from the interior surface of the web member and having an outer surface on one side of the side member that corresponds to the side surface and an interior surface on the opposite side of the side member; and iii. a substantially planar lip flange laterally connected to the side member opposite from the web member, the lip flange being disposed parallel to the web member and orthogonally to the side member, the lip flange running alongside the side member and being disposed on the interior surface of the web member, the lip flange having a selected width that is substantially narrower than the web member, the lip flange having an interior surface that faces the interior surface of the web member on one side of the lip flange and a facing surface on the opposite side of the lip flange that corresponds to the lip surface;

b. a backing connector, the backing connector being disposed substantially in alignment with the wall stud and connecting the wall stud to one or more backing members, the backing connector including, i. a web, the web being elongated and substantially planar, the web having a longitudinal axis with an upper end and a lower end, the web having an exterior surface on one side of the web and an interior surface on the opposite side of the web, the interior surface of the web being substantially in alignment with and interfacing with the side surface of the wall stud, and ii. first and second, substantially planar lateral side plates extending laterally from the web of the backing connector, at least one of the first and second lateral side plate members interfacing with at least one of the one or more backing members;

c. one or more fasteners connecting the backing connector to the wall stud where the backing connector interfaces with the wall stud the one or more fasteners being driven through the web of the backing connector and into the side surface of the wall stud; and d. one or more fasteners connecting at least one of the first and second lateral side plates to at least one of the one or more backing members;

e. at the lower end of the web, the web is provided with first and second attachment tabs that extend orthogonally from the web with the first attachment tab interfacing with the lip surface of the wall stud and the second attachment tab interfacing with the front surface of the wall stud; and f. the first attachment tab is connected to a first curved strengthening flange that turns and flares outwardly from the orientation of the first attachment tab and the second attachment tab is connected to a second curved strengthening flange that turns and flares outwardly from the orientation of the second attachment tab.

11. The connection of claim 10, wherein:

one or more fasteners connect the first attachment tab to the lip surface of the wall stud and one or more fasteners connect the second attachment tab to the front surface of the wall stud.

12. The connection of claim 10, wherein:

the web of the backing connector is formed with one or more grooves that extend parallel with the longitudinal axis of the backing connector.

13. The connection of claim 10, wherein:

the web of the backing connector is formed with side portions, and the side portions are provided with one or more grooves that extend parallel with the longitudinal axis of the backing connector.

14. The connection of claim 10, wherein:

a. the first and second lateral side plates are formed with undulating, curved side edges with protruding portions and indented portions; and b. fastener openings are formed in the first and second lateral side plates in or adjacent to the protruding portions.

15. The connection of claim 10, wherein: the one or more backing members are formed with bottom edges and first and second strengthening tabs each interface with a bottom edge of one of the one or more backing members.

16. The connection of claim 10, wherein:

the fasteners are self-drilling and self-tapping screws with heads.

17. The connection of claim 10, wherein:

the web of the backing connector is formed with one or more indicia members that extend parallel with the longitudinal axis of the backing connector.

18. The connection of claim 10, wherein:

the web of the backing connector is formed with side portions, and the side portions are provided with one or more indicia members that extend parallel with the longitudinal axis of the backing connector.

* * * * *